United States Patent [19]

Maguire, III

[11] Patent Number: 4,764,761

[45] Date of Patent: Aug. 16, 1988

[54] EARTHQUAKE ALARM

[76] Inventor: John N. Maguire, III, 1500 N. Ocean Blvd., Apt. #1003, Pompano Beach, Fla. 33063

[21] Appl. No.: 105,308

[22] Filed: Oct. 7, 1987

[51] Int. Cl.[4] ..... G08B 21/00; H01H 35/02

[52] U.S. Cl. ..... 340/690; 200/61.45 R; 200/DIG. 29; 307/121

[58] Field of Search ..... 340/690, 689; 307/121; 200/DIG. 29, 61.45 R, 61.52; 33/366

[56] References Cited

U.S. PATENT DOCUMENTS

| | | | |
|---|---|---|---|
| 2,794,084 | 5/1957 | Segoni | 340/689 X |
| 2,912,535 | 11/1959 | Sullivan | 200/61.48 |
| 4,001,185 | 1/1977 | Mitsui et al. | 200/61.45 R |
| 4,107,545 | 8/1978 | Gittelis | 307/121 |
| 4,124,841 | 11/1978 | Kettunen | 340/690 |
| 4,214,238 | 7/1980 | Adams et al. | 340/690 |
| 4,297,690 | 10/1981 | Baker | 340/690 |
| 4,528,559 | 7/1985 | Freeman | 340/690 |
| 4,616,320 | 10/1986 | Kerr et al. | 364/421 |
| 4,697,174 | 9/1987 | Viator, Sr. | 340/689 |

FOREIGN PATENT DOCUMENTS

| | | | |
|---|---|---|---|
| 253891 | 3/1970 | U.S.S.R. | 200/DIG. 29 |

*Primary Examiner*—Glen R. Swann, III
*Assistant Examiner*—Thomas J. Mullen, Jr.
*Attorney, Agent, or Firm*—Oltman and Flynn

[57] ABSTRACT

Earthquake sensing device which has a ball with a metallic surface which is resting atop a perch having a narrow upper base. In case of a tremor, the ball falls off the perch and is intercepted by a contact plate and thereby closes an electric circuit which includes the ball, the perch, the contact plate, a power supply and an electric sounder, which is activated to sound an alarm.

10 Claims, 2 Drawing Sheets

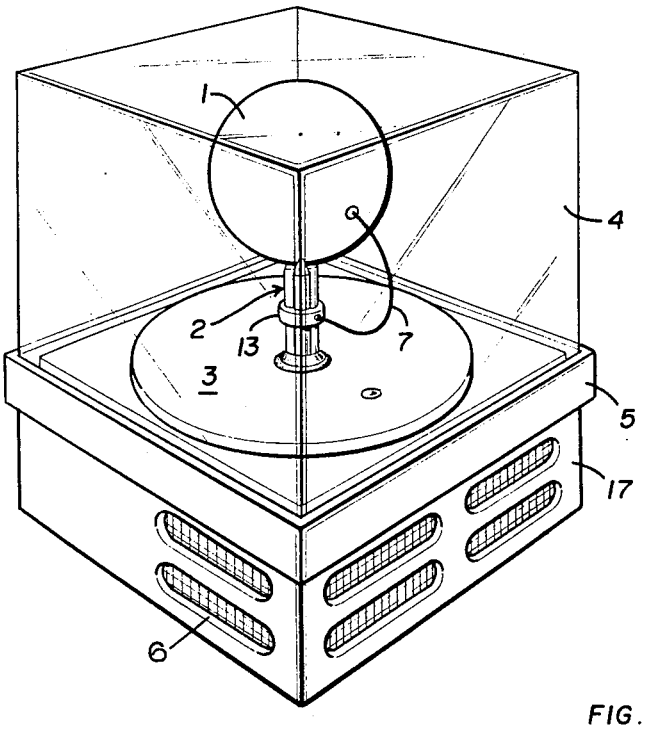
FIG. 1
FIG. 2
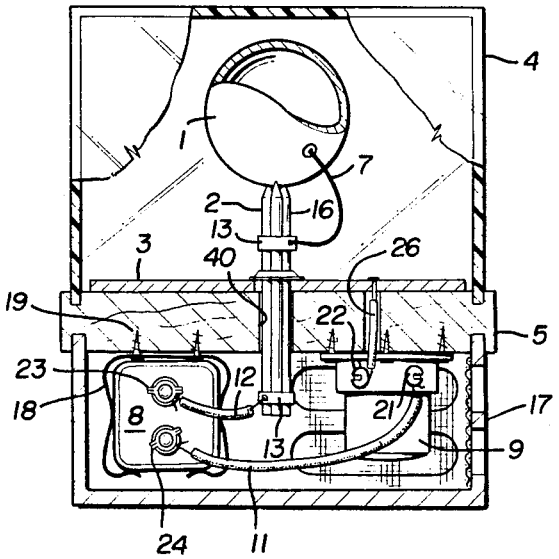

EARTHQUAKE ALARM

BACKGROUND AND PRIOR ART

The invention relates to earthquake alarms, and more particularly to a small alarm device having a ball on a perch electrically connected to a power source and a sound emitter which is actuated by an electric circuit being closed when the ball falls off the perch, due to earthquake tremors.

It is well known that earthquakes often present great dangers, especially if they occur at night, when people are asleep and are not aware of early warnings, such as the early small tremors that usually precede a serious major earthquake, also called foreshocks. Foreshocks may precede an earthquake by hours or days.

Earthquake measuring and warning devices are well known in the form of seismographs, that sense and record earthquakes and may provide early warnings in cases wherein the earthquake is preceded by foreshocks. Seismographs, however, are typically large and expensive scientific instruments that are not available to ordinary people.

A small motion detection device is known from U.S. Pat. No. 4,124,841, which shows a small metallic pin standing on one end atop a battery, and, in case a tremor is detected, topples and closes an electric circuit. The latter device, however, has the drawback that the small pin when toppled only provides a small and unreliable contact pressure and therefore is not always a reliable warning.

It is, therefore, an object of the instant invention to provide an earthquake sensing device that is highly sensitive and reliable, yet is inexpensive in construction.

SUMMARY OF THE INVENTION

The earthquake sensing device, according to the instant invention includes a ball having a given weight, and at least a metallic surface but is advantageously of solid metal, which is perched atop a narrow upstanding perch having an upper small base constructed such as to support the ball atop the perch on the base so that even a minor tremor causes the ball to fall off the perch; a metallic contact surface below the top of the perch which serves to intercept the ball when it falls off the perch; and an electric circuit that includes the ball, the contact surface, an electric power source and an electric alarm sounder, that is activated when the ball falls off the perch and completes the circuit.

According to a further feature, the electric circuit includes a wire or ball chain connection between the ball and the circuit.

According to a still further feature, the device includes a housing for enclosing the device. The housing may advantageously have a removable upper part for accessing and restoring the ball to the top of the perch.

In accordance with still another feature, the upper housing part is transparent to make the ball visible.

In accordance with still another feature, a test contact is provided which serves to manually test the circuit.

In accordance with a still further feature, the power source is a dry cell battery or an ac power supply or a storage battery, advantageously of the NiCad type.

Other objects of this invention will appear from the following description and appended claims, reference being had to the accompanying drawings forming a part of this specification wherein like reference characters designate corresponding parts in the several views.

BRIEF DESCRIPTION OF THE FIGURES OF THE DRAWING

FIG. 1 is a perspective view of the invention, showing the ball atop the perch visible inside the housing upper part.

FIG. 2 is an elevational part cross-sectional view of the invention showing the ball, parts of the electrical circuit and the perch wherein the upper base is formed of three points.

Figure 3:
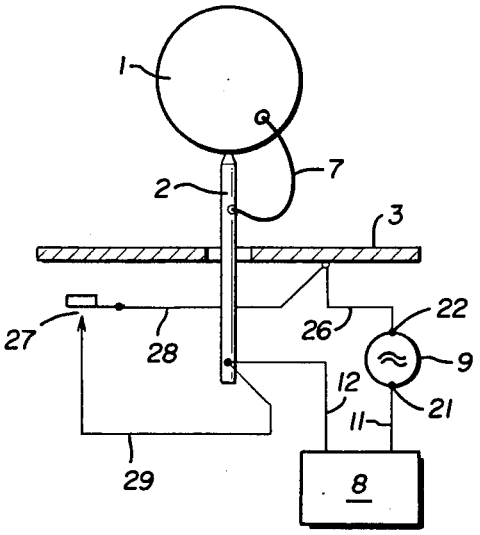
FIG. 3 is an electrical wiring diagram of the invention showing the major parts of the electrical circuit.

Before explaining the disclosed embodiments of the present invention in detail, it is to be understood that the invention is not limited in its application top the details of the particular arrangements shown, since the invention is capable of other embodiments. Also, the terminology used herein is for the purpose of description and not of limitation.

DESCRIPTION OF THE PREFERRED EMBODIMENTS

In FIG. 1 a ball 1 is shown resting atop a perch 2. The ball has at least a metallic surface but is advantageously of solid or hollow metal, and has a certain weight such that it rests securely on the top of the perch 2. The perch 2 is formed of three metallic rods 16, each having a pointed tip 14 best seen in FIG. 4*a*. The rods 16 are held together as a firm bundle by the rings 13. The three tips 14 are facing upward and form a three-point base supporting the ball 1. The three point base forms a well defined secure base for the ball, yet the base is small enough so that even a minor vibration will cause the ball to fall off the perch. A flexible thin wire 7 provides an electrical connection between the ball and the upper ring 13.

The perch 2 is supported in a base plate 5 made of an insulating material, e.g. wood or plastic, having a center hole 40 tightly fitting and holding the perch 2 which projects upward through the hole with the lower ring 13 below the base plate and the upper ring 13 above the base plate.

A metallic contact surface or plate 3 is fastened to the upper surface of the base plate 5 and serves to intercept the ball 1 if it is dislodged from the perch by a tremor.

A lower compartment is formed by a lower housing part 17 and the underside of the base plate 5 which encloses an electric power supply 8 in the form e.g. of a dry cell battery, an ac-powered power supply or a storage battery. The type of power supply is immaterial to the scope of the invention. The power supply 8 is secured to the underside of the base plate 5 by a spring 18 or other suitable retainer, attached by screws 19 or the like to the base plate 5. An electric alarm sounder 9 is also secured to the underside of the base plate 5.

The sounder 9 has one terminal 21 connected to one terminal 24 of the power supply via lead 11, and another terminal 22 connected via lead 26 to the metallic contact plate 3. The other power supply terminal 23 is connected via lead 12 to the lower ring 13, through the rods 16 of the perch 2 and the wire connection 7 to the ball 1.

In case of a tremor the ball 1 falls off the perch 2 and is intercepted by the contact plate 3. In this state an electric circuit is closed between the metallic surface of the ball 1 and the contact plate 3, which activates the sounder 9. Sound holes 6 in the lower housing part 17 allow the sounder 9 to be heard outside the device.

An upper housing part 4, advantageously made of a transparent material sits atop the base plate 5 and provides access to the ball 1, so that it can be restored to the top of the perch 2, thereby opening the circuit and stopping the sounder 9.

A wiring diagram of the device is shown in FIG. 3, which shows the connections described above. FIG. 3 also shows a test switch 27 having leads 28,29, which, when operated, closes the electric circuit between the power source 8 and the sounder 9, and thereby serves to provide a manual operational test of the device.

Figure 4:
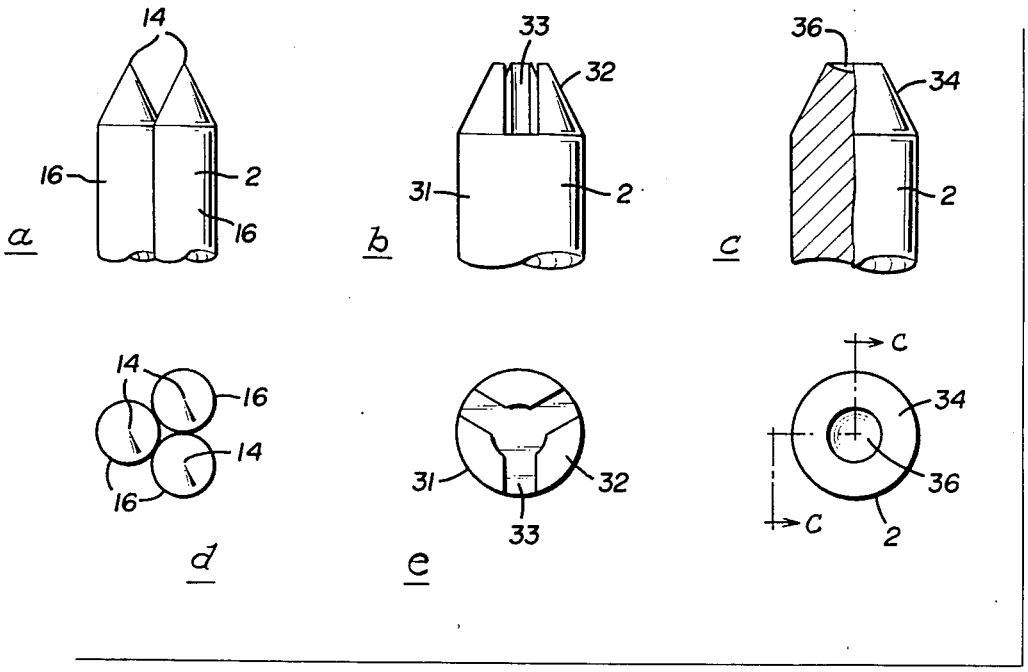
FIG. 4*a–f* shows various forms of the perch.

FIGS. 4*a–f* show various forms of the upper part of the perch 2. FIGS. 4*a* and *d* show respectively an elevational and a plan view of the perch described above, having the rods 16, each having an upward facing point 14, forming a three point base for the ball 1. FIGS. 4*b* and *e* show respectively an elevational and a plan view of a perch formed of a single rod 31, having three grooves 33 milled in its top, thereby forming three upward facing tips 32 which can support the ball 1. FIGS. 4*c* and *f* show, respectively, an elevational and a plan view of the perch 2, having an upper truncated cone 34, which has in turn an upper recessed base 36 for supporting the ball 1.

I claim:

1. An earthquake sensing device comprising a ball having a metallic surface; an upstanding perch having an upper narrow top base for supporting the ball; a metallic contact plate below the top base for intercepting the ball when it is off the top base; and an electric circuit including a power supply, an electric sounder, said perch, said ball and said base, which is closed to activate the sounder when the ball is touching the contact plate; said electric circuit further including a flexible wire connection between said ball and said perch.

2. The earthquake sensing device according to claim 1 wherein said top base includes three upward facing points for supporting the ball.

3. The earthquake sensing device according to claim 1 wherein said power supply is selected from the group consisting of dry cell batteries, ac-power supplies and Ni-Cad batteries.

4. The earthquake sensing device according to claim 1 including a test switch being connected to said electric circuit for manually testing said circuit.

5. The earthquake sensing device according to claim 1, including a housing having an upper removable part for enclosing said ball, and a lower part for enclosing a portion of said electric circuit.

6. The earthquake sensing device according to claim 5 wherein said lower housing part has sound holes for admitting sound from the sounder to the outside of the housing.

7. The earthquake sensing device according to claim 5, wherein said upper housing part is made of transparent material.

8. The earthquake sensing device according to claim 1 wherein said perch has three pointed metallic rods held together by at least two metal rings.

9. The earthquake sensing device according to claim 1 including a base plate for supporting said contact plate and having a hole for receiving said perch in a tight fit.

10. The earthquake sensing device of claim 1 wherein said ball is of metal.

* * * * *

UNITED STATES PATENT AND TRADEMARK OFFICE

CERTIFICATE OF CORRECTION

PATENT NO. : 4,764,761

DATED : August 16, 1988

INVENTOR(S) : John N. Maguire III

It is certified that error appears in the above-identified patent and that said Letters Patent are hereby corrected as shown below: Title page Please change address of applicant to read:

John N. Maguire III
149 Cabana Rd.
Briar Cliff Acres
Myrtle Beach, S.C. 29577

Signed and Sealed this

Tenth Day of January, 1989

*Attest:*

DONALD J. QUIGG

*Attesting Officer*

*Commissioner of Patents and Trademarks*